United States Patent [19]

Hosaka et al.

[11] Patent Number: 4,811,047

[45] Date of Patent: Mar. 7, 1989

[54] IMAGE FORMING APPARATUS WITH MEANS FOR RECOGNIZING AN ORIGINAL CONDITION

[75] Inventors: Masao Hosaka, Sagamihara; Shizuo Hasegawa, Yokohama; Takashi Saito, Ichikawa, all of Japan

[73] Assignee: Canon Kabushiki Kaisha, Tokyo, Japan

[21] Appl. No.: 933,290

[22] Filed: Nov. 25, 1986

Related U.S. Application Data

[63] Continuation of Ser. No. 643,246, Aug. 22, 1984, abandoned.

[30] Foreign Application Priority Data

| | | | |
|---|---|---|---|
| Aug. 25, 1983 | [JP] | Japan | 58-155339 |
| Aug. 25, 1983 | [JP] | Japan | 58-155340 |
| Sep. 28, 1983 | [JP] | Japan | 58-179737 |

[51] Int. Cl.[4] ..... G03G 15/00

[52] U.S. Cl. ..... 355/14 E; 355/14 R; 355/7

[58] Field of Search ..... 355/14 SH, 14 R, 3 SH, 355/3 R, 8, 14 E, 7; 358/285, 288, 300; 346/153.1, 160

[56] References Cited

U.S. PATENT DOCUMENTS

| | | | |
|---|---|---|---|
| 3,912,387 | 10/1975 | Brooke | 355/3 R |
| 4,200,391 | 4/1980 | Sakamoto | 355/14 E |
| 4,371,256 | 2/1983 | Yoshimura et al. | 355/14 SH |
| 4,474,453 | 10/1984 | Yanagawa | 355/14 C |

FOREIGN PATENT DOCUMENTS 54-54627 5/1979 Japan .

*Primary Examiner*—R. L. Moses

*Attorney, Agent, or Firm*—Fitzpatrick, Cella, Harper & Scinto

[57] ABSTRACT

A copying machine has exposure lamps for scanning an original, line sensors for recognizing an original pattern, an imaging lens, a blank exposure lamp to eliminate a black frame and a central black stripe of a reproduced image if the original is thick (i.e., book), and a controller with an MCU. The set condition and shape of the original are recognized and displayed to allow optimal image formation.

51 Claims, 12 Drawing Sheets

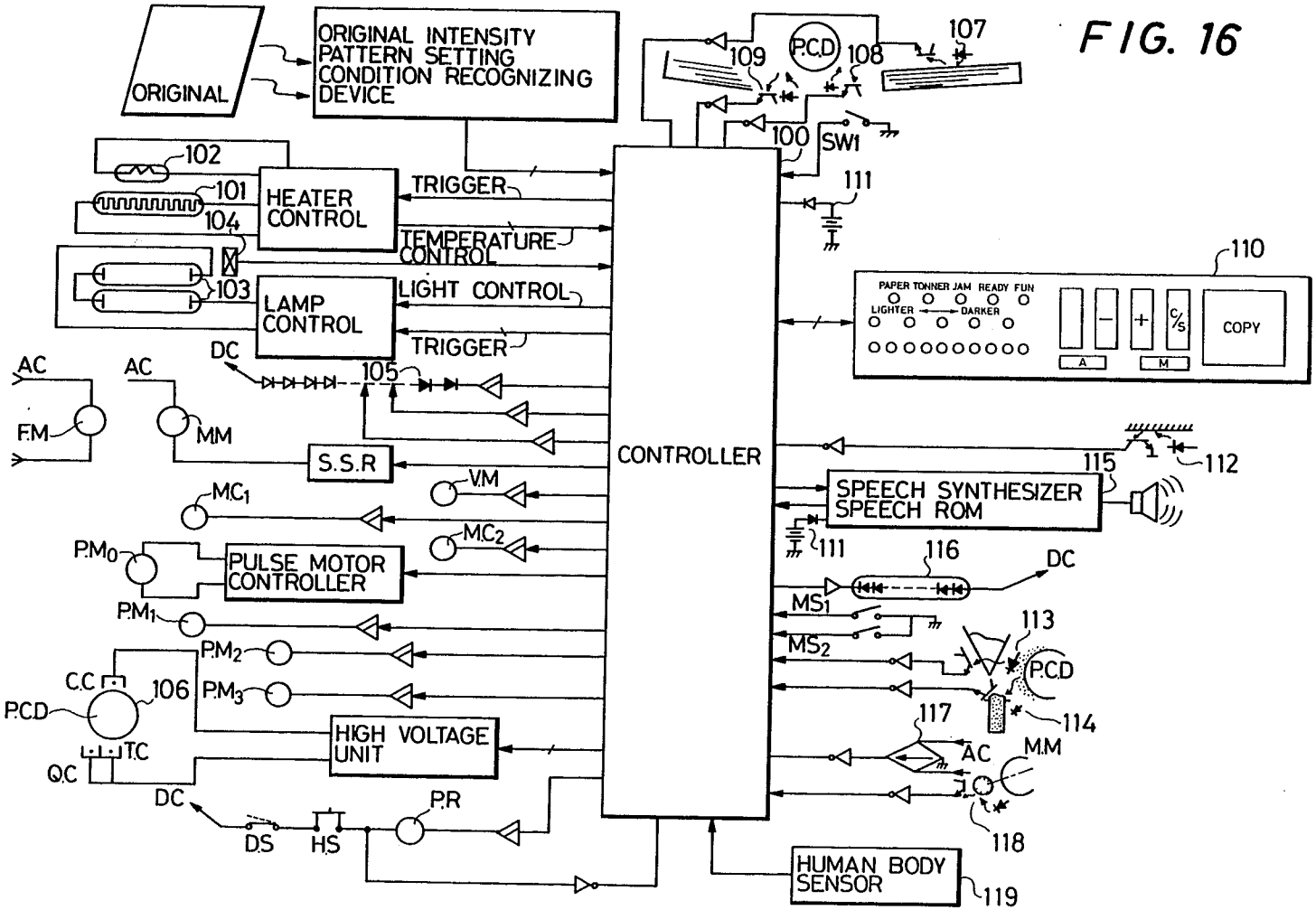
FIG. 16
ORIGINAL
ORIGINAL INTENSITY PATTERN SETTING CONDITION RECOGNIZING DEVICE
CONTROLLER
HEATER CONTROL
LAMP CONTROL
TRIGGER
TEMPERATURE CONTROL
LIGHT CONTROL
TRIGGER
S.S.R
PULSE MOTOR CONTROLLER
HIGH VOLTAGE UNIT
SPEECH SYNTHESIZER SPEECH ROM
HUMAN BODY SENSOR
COPY
PAPER TONNER JAM READY FUN
LIGHTER
DARKER
P.C.D
M.M
F.M
V.M
M.C1
M.C2
P.M0
P.M1
P.M2
P.M3
P.R
H.S
D.S
C.C
T.C
Q.C
SW1
MS1
MS2
AC
DC ORIGINAL
ORIGINAL INTENSITY PATTERN SETTING CONDITION RECOGNIZING DEVICE
CONTROLLER
HEATER CONTROL
LAMP CONTROL
TRIGGER
TEMPERATURE CONTROL
LIGHT CONTROL
TRIGGER
N.T.C
DC
AC
F.M
M.M
S.S.R
V.M
M.C1
M.C2
PULSE MOTOR CONTROLLER
P.M0
P.M1
P.M2
P.M3
HIGH VOLTAGE UNIT
C.C.F
P.C.D
T.C
Q.C
P.R
S.H
S.D
SPEECH SYNTHESIZER SPEECH ROM
SP
L.C.D
COPY
111'
111'-1
SW1
P.C.D
e1
e2
e3
MS1
MS2
HUMAN BODY SENSOR

IMAGE FORMING APPARATUS WITH MEANS FOR RECOGNIZING AN ORIGINAL CONDITION

This application is a continuation of application Ser. No. 643,246, filed Aug. 22, 1984, abandoned.

BACKGROUND OF THE INVENTION

1. Field of the Invention

The present invention relates to an image formation apparatus for performing image processing.

2. Description of the Prior Art

In a conventional analog copying machine, in order to perform a copy operation, an intensity (or density) key or a diaphragm dial is adjusted in accordance with the intensity of an original so as to set a desired intensity (density) level. This operation requires a test copy operation, resulting in an uneconomical operation and poor operability. However, when recent developments in AE technologies in the field of copying machines, a method has been proposed in which the intensity of an image is measured with reflected light from the image or an electrostatic latent image on a photosensitive body is detected by an electrostatic sensor so as to discriminate the contrast, thereby forming images of optimal intensities. However, in practice, this method of detecting an intensity of an image does not allow clear discrimination between a line image portion and a solid image portion, and an optimal image may not be obtained. In a copying machine, in order to produce a copy image of an original image, the original is set on an original table or glass contact and covered with a cover so as not to allow ambient light to become incident on the optical system of the copying machine. If ambient light becomes incident on the optical system, the portion of the reproduced image corresponding to a light incident portion is reproduced black in color. In this case, an extra amount of toner is attached to this portion of the image, which is not preferable from the viewpoint of the characteristics of the photosensitive body. However, when the original is covered with the cover, the set condition of the original cannot be visually confirmed. For this reason, when the original is not placed at a suitable position on the original table or the original is of a size larger than a predetermined size, only poor image reproduction can be performed.

Originals include various documents such as thin sheets or book documents. In particular, a book has a considerable thickness. When an image of a certain page of such a book is to be copied, a shadow is formed at an edge of the book. This results in a black frame corresponding to an edge of a reproduced image, or a black stripe is formed at the center of the image, resulting in a poor image and in a poor operability.

SUMMARY OF THE INVENTION

It is an object of the present invention to eliminate the drawbacks of the conventional image formation apparatuses as described above.

It is another object of the present invention to provide an improvement in an image formation apparatus.

It is still another object of the present invention to provide an image formation apparatus which can recognize a set condition, an intensity or density or the like of an original and can form an optimal image.

It is still another object of the present invention to provide an image formation apparatus which can recognize a set condition of an original and can display a pattern of the original image.

It is still another object of the present invention to provide an image formation apparatus which can eliminate a black frame in a reproduced image which corresponds to an edge of an original image.

It is still another object of the present invention to provide an image formation apparatus which can handle with a single means position information and intensity information of an original.

It is still another object of the present invention to provide an image formation apparatus which can reduce the image formation time.

It is still another object of the present invention to provide an image formation apparatus which can recognize position information of an origianl during an image formation operation.

It is still another object of the present invention to provide an image formation apparatus which can display an original image pattern during an image formation operation.

The above and other objects, features and advantages of the present invention will become apparent from the following description taken in conjunction with the accompanying drawings and appended claims.

BRIEF DESCRIPTION OF THE DRAWINGS

FIG. 16 is a block diagram showing the configuration of an apparatus according to an embodiment of the present invention;

FIG. 21-1 is a flow chart showing a copy process in original pattern recognition;

FIG. 21-2 is a flow chart of original pattern recognition; and,

DETAILED DESCRIPTION OF THE PREFERRED EMBODIMENTS

The preferred embodiments of the present invention will be described with reference to the accompanying drawings.

Figure 1:
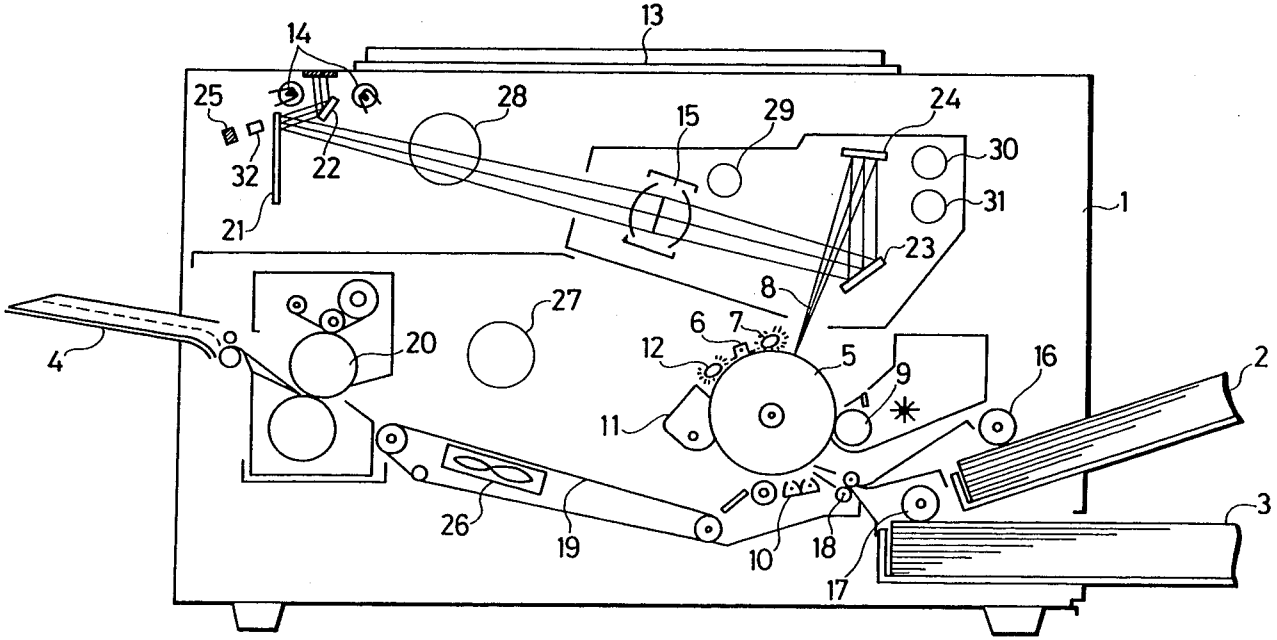
FIG. 1 is a sectional view of an apparatus to which the present invention is applicable.

A method of detecting an original set position will first be described. FIG. 1 is a sectional view showing the construction of an image formation apparatus to which the present invention may be applied. Details of this apparatus will be described later.

Figure 2:
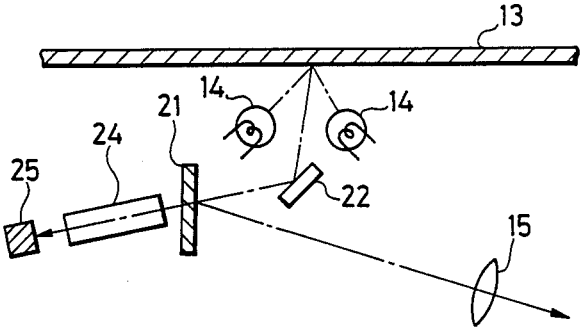
FIG. 2 is a sectional view of an optical system of the apparatus shown in FIG. 1.

FIG. 2 is a sectional view showing an example of an optical system to be used for recognition of an original pattern and for detecting an original intensity. A one-to-one line sensor 25 serves to perform a pattern recognition of an original. A SELFOC lens 24 guides the optical system path toward the line sensor 25. A half mirror 21 and a mirror 22 form an optical system light path. Exposure lamps (fluorescent lamps) 14 illuminate an original placed on an original table 13. An imaging lens 15 focuses light to form a latent image on a photosensitive body to be described later.

Light emitted by the exposure lamps 14 and reflected by the original is partially guided to the imaging lens 15. The light portion which is transmitted through the half mirror 21 is passed through the SELFOC lens 24 and forms an image on the one-to-one line sensor 25 so as to perform pattern recognition, intensity detection and the like of an original. The one-to-one line sensor 25 can comprise a CCD or an a-Si (amorphous silicon) line sensor which has been developed recently. In the example shown in the drawings, light emitted by the exposure lamps and reflected by the original is guided to the line sensor through the half mirror. However, a separate light source for a line sensor can be used together with a combination of a SELFOC lens and a one-to-one sensor.

Figure 3:
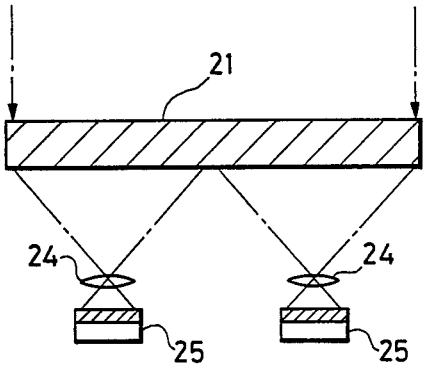
FIG. 3 is a top view of the optical system of the apparatus shown in FIG. 1.
Figure 4:
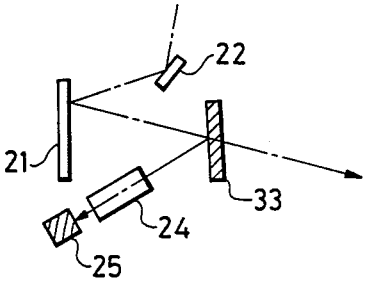
FIG. 4 is a top view of another example of the optical system of the apparatus shown in FIG. 1.

FIG. 3 is a top view showing a combination of line sensors 25, SELFOC lenses 24, and a half mirror 21 In the configuration shown in FIG. 4, a half mirror 33 is arranged on the optical path, and reflected light from the half mirror 33 is guided to a line sensor 25. In this case, the member 21 need not be a half mirror.

The line sensors, the fluorescent laps, the SELFOC lens, and the half mirror are formed integrally and are scanned on an original surface. Before an actual copy operation, prescan of an original is performed so as to recognize the intensity, a shape (book or sheet), a set condition and the like of the original. Such recognition is performed in accordance with reflected light from the original.

Figure 5:
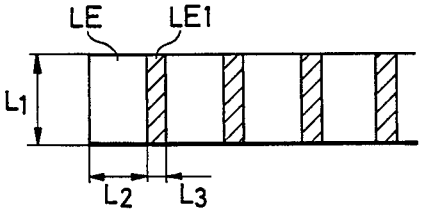
FIG. 5 is a representation showing the shape of a line sensor element.
Figure 6:
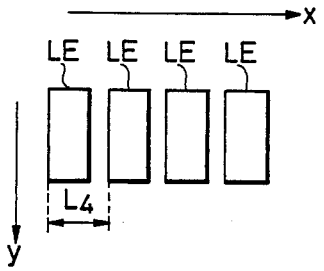
FIG. 6 is a representation for explaining a sampling method with a line sensor.

FIG. 5 is a view showing an example of a shape of a line sensor pixel element. Referring to FIG. 5, L1 is 62.5 μm, L2 is 20 μm, and L3 is 5 μm. Pixel elements LE perform image sensing. Barriers LE1 separate th adjacent pixel elements LE. FIG. 6 is a view showing a sampling method of the line sensor. Line sensor elements LE perform image sensing. L4 is a sum of lengths L2 and L3 and is 25 μm. Sampling in the y direction is subscanning and is mechanically performed by moving the optical system. Sampling in the x direction is main scanning and is performed in response to clocks received by the line sensor. Upon this sampling operation, a video output is obtained. This video output is subjected to A/D conversion to recognize an intensity pattern of an original. A/D conversion is performed for every transfer bit. For this reason, a high-speed flash A/C converter operative at a speed of several microseconds is used. Two line sensors are used as shown in FIG. 3, and each line sensor has 512 bits. However, a single line sensor of 1024 bits can be used instead. Furthermore, the number of bits of a line sensor can be changed in accordance with the required resolution, economy requirement and the like. In the case of an A4 size original, it generally has length of about 300 mm. When a line sensor of 1,000 bits is used, a resolution of 0.3 mm is obtained. Since the resolution significantly affects discrimination performance of an image boundary or thin line pattern, the resolution is preferably as high as possible. However, in general case, discrimination of lines and image patterns can be performed with a resolution of 0.3 mm as in this embodiment. When the resolution is too low, an average value is detected at the boundary between white and black image portions and a correct discrimination of thin lines and image boundaries cannot be performed. Therefore, in order to improve the discrimination precision, the diameter of the line sensor cell is preferably small and the number of bits is preferably large.

Figure 7:
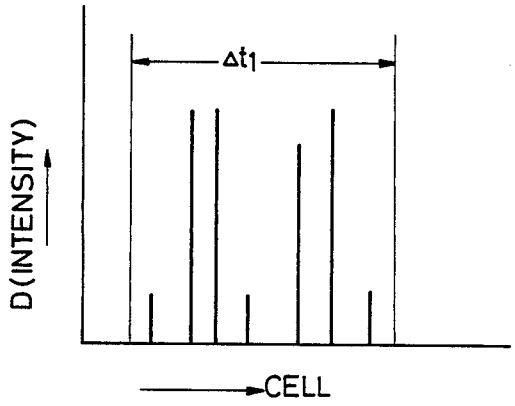
FIG. 7 is a graph showing the intensity pattern of a line image and a character image.
Figure 8:
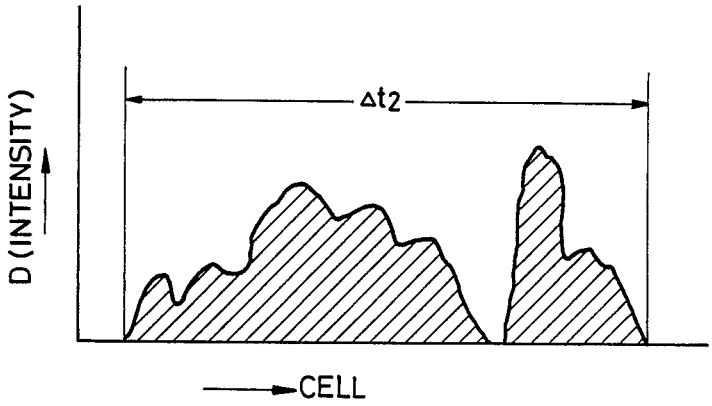
FIG. 8 is a graph showing the intensity pattern of a photographic image.

Recognition of an original intensity will be described below. FIG. 7 is a graph showing an intensity pattern of a line and a character. The intensity, shape and set condition of an original are simultaneously detected. A video output from a line sensor is A/D converted to allow detection of an intensity pattern and changes in intensity so as to discriminate a character and a line. The rate of change (Δt1) in intensity of a line or character image per nit time is given in the form of binary data of "1" and "0", as shown in FIG. 7. FIG. 8 shows an intensity pattern of a photographic image. A photographic image has more halftone portions than a character or line image and has continuous intensity changes as shown in FIG. 8. Since many images involve continuous halftone or solid portions, recognition of rate of change in intensity in these images enables discrimination of a line, character or photographic image. In order to do this, prescan is performed to determine the ratio of character to image areas. In accordance with the determined ratio, the process conditions, such as electrification, exposure, and developing bias and the like are set. Actual image scan is then performed in accordance with set conditions. Alternatively, intensity data of a certain range of an original can be integrated to determine the original intensity. If the intensity detection range reaches from an exposure position on a drum to the developing position, real time intensity detection and bias control can be performed within a time period from exposure to development. If the original set condition is determined to be abnormal as a result of prescan, the optical axis angle of the mirror is adjusted so that the optical path is corrected during actual scan. If automatic correction of the optical axis angle of the mirror cannot be performed due to too large an original displacement, a warning, either visual or audio, is produced to signal this to the operator. When an original image is subjected to photoelectric conversion and printing is performed in accordance with the binary video signal, an image of an optimal image can be printed by selecting a threshold level in digitization.

Detection of the set condition of an original will be described next.

Figure 9:
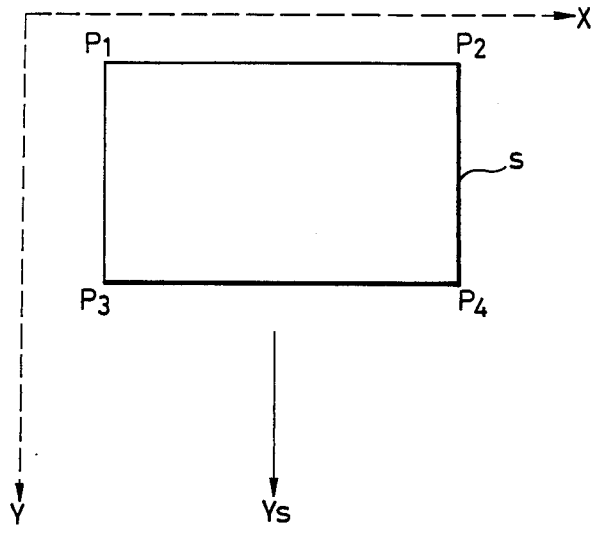
FIG. 9 is a representation showing an original pattern which is normally set.

FIG. 9 shows an original S which is set normally The original S has corners P1, P2, P3 and P4, in this case. The original S is scanned in a direction YS. When exposure scan is performed, the corners P1 and P2 are detected by the line sensor, and the corners P3 and P4 are then detected to determine the size of the original. The set condition of the original is detected by whether or not the difference in the positions of the corners P1 and P2 in the y direction or that of the corners P3 and P4 falls within the permitted value (allowance) of several millimeters When the set condition is normal as shown in FIG. 9, the corners P1 and P2 are detected simultaneously, and the corners P3 and P4 are detected simultaneously after some scanning period.

Figure 10:
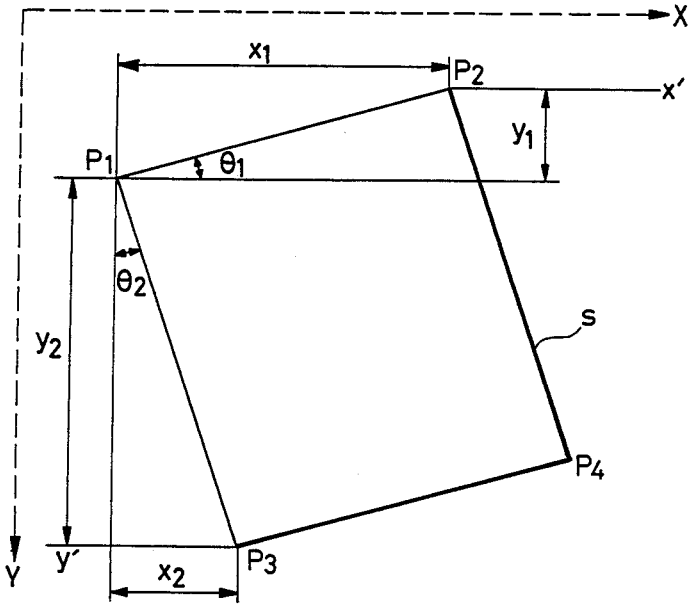
FIG. 10 is a representation showing an original pattern which is set with a ramp.

When the original is set with a ramp as shown in FIG. 10, the line sensor detects the corner P2 first and then corners P1, P4 and P3, in the order named. The order of detected corners of an original is different depending upon the direction and angle of the ramp. In the case of a rectangular or square original, the degree of a ramp can be determined in accordance with the detection time difference between the corners P1 and P2 or the corners P3 and P4. When the time difference exceeds a permitted value, it is determined that the set condition is abnormal Then, a warning can be produced to signal this to the operator. A visual display can be used to signal the same to the operator.

Referring to FIG. 10, a ramp $\theta 1$ of the original S can be determined from a distance x1 between the read positions of the corners P1 and P2 in the horizontal direction and a distance y1 between the same in the vertical direction in accordance with a relation $\theta 1 = \tan^{-1}(x1/y1)$. The direction of the ramp can be determined in accordance with which one of the corners P1 and P2 is read first.

Figure 11:
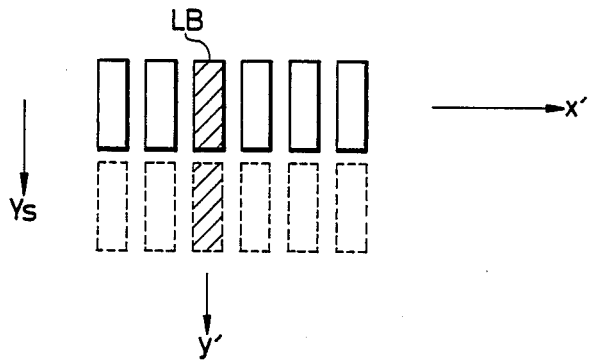
FIG. 11 is a diagram showing a reference bit of a line sensor.

If an original is corrected with a previous ramp $\theta 1$, an error may be caused. In other words, the shape of the original may not be rectangular. The general user may want to copy excerpts from newspapers or magazines. Such originals must also be discriminated. As described above, the set condition of the original can be performed by reading the corners P1 and P2. However, a rectangular original can be detected by reading up to the corners P3 and P4. Scan is performed by a line sensor in a main scan direction X and by moving an original table or an optical table or an optical system in a subscan direction Y. When an imaginary line in the direction X is represented by x', it is obtained by main scan by the line sensor FIG. 11 shows a representation showing a reference bit of the line sensor. An imaginary line y' in the direction Y is obtained by mechanical scan Ys of the optical system or by scanning reference bits LB when a specific pixel of the line sensor is defined as a reference bit. In this manner, even if reference x-and y-axes are not provided on the original table of the copying machine, the set condition of the original can be determined and can be corrected. The ramp in the vertical direction can be determined in accordance with $\theta 2 = \tan^{-1}(x2/y2)$ as shown in FIG. 10. Correction of quantities $\theta 1$ and $\theta 2$ to be corrected is performed by correcting the path of the optical system with pulse motors 30 and 31 such that the original is mechanically located at the normal position Therefore, if the ramp of the original falls within a permitted value within a certain range of the original table, a normal copy can be reproduced as if the original is set with reference to reference marks. When an image of an original is subjected to photoelectric conversion and the resultant image data is stored in a memory for subsequent readout for printing, the read address from the memory can be controlled in accordance with the recognition result of the original set condition. Then, the image can be printed out at an optimal position or direction.

In the above description, the size, type and the like of the original are determined in accordance with detection of corners of originals. However, in addition to this detection, the reflected light from the original must be distinguished from reflection from an original cover.

The method of detecting an original corner will be described below. In the example shown in FIG. 10, the imaginary lines x' and y' are obtained using the line sensor. However, a video output from the line sensor is also obtained. Since this video output requires precise analog signal processing as compared to a CCD wherein discrimination of "1" and "0" is simply performed, a MOS-type line sensor with good linearity is preferable. In order to discriminate an original from an original cover, the reflected intensity of a cover is detected and the detected intensity is stored when no original is placed on the original table. When an original is placed, it is discriminated from the cover referring to the stored value of the reflected intensity from the cover. In order to allow easy discrimination of an original from an original cover, the original cover may be black in color or a paint having a small reflectance can be coated on the inner surface of the cover. Then, the standard reflected intensity of the original cover is obtained, and discrimination of an original from an original cover can be performed by comparison of the actual data with the reflected intensity from the cover. When reflected light from an edge of an original is projected on a cell of a line sensor, the reflected light intensity changes with sub scan time, When the original has a ramp as shown in FIG. 10, the corner P2 is detected first. When the time elapses further, the corner P1 is detected to allow detection of the ramp angle with reference to the reference bit of the imaginary line y'. As has been described above, this discrimination is performed by performing A/D conversion of a reflectance of the original cover and that of an original and comparing the digital values obtained.

Description of the type of an original, i.e., a sheet or book, will be described next.

Figure 12:
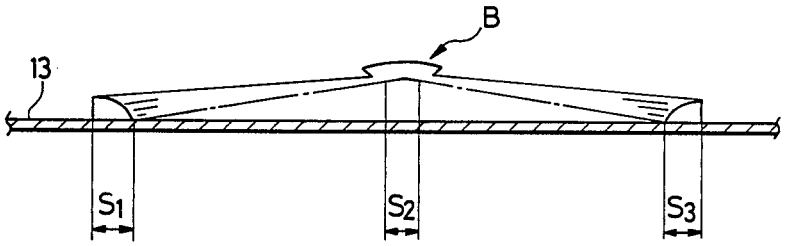
FIG. 12 is a representation showing a shadow of an original.
Figure 13:
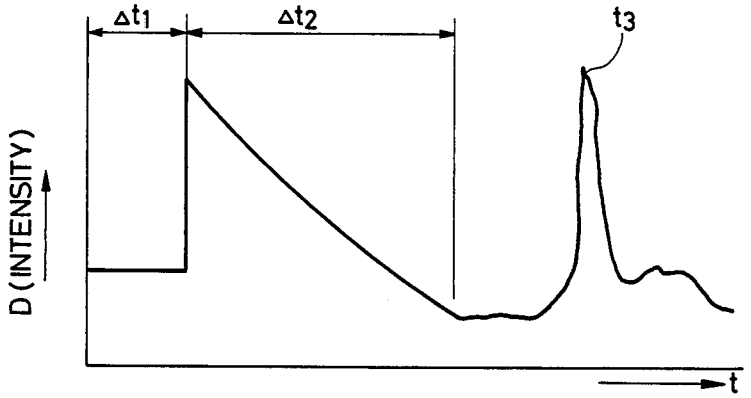
FIG. 13 is a graph showing a reflection intensity of an original.
Figure 14:
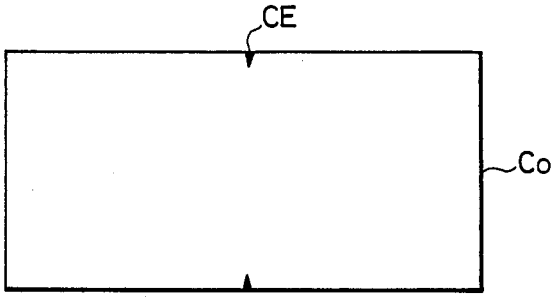
FIG. 14 is a representation showing center marks.

When a book original is to be copied, since it has a certain thickness, the cover floats over the original. Then, ambient light becomes incident on the optical system, and a copy with a black background is produced. Furthermore, the central gutter portion of the book original floats and a black stripe is formed at the center of the image. In view of this problem, discrimination between a sheet and a book is performed. Blank exposure is performed so as to eliminate the black frame and the central black stripe. Discrimination between a sheet or a book amounts to detection of the thickness of an original. When an original is illuminated with light incident at a certain angle, a shadow is formed if this original has a certain thickness. This shadow has a gray level corresponding to the thickness of the original. Therefore, an image of a book has a pattern apparently different from a sheet, so that a sheet and a book can be easily discriminated from each other. FIG. 12 shows a manner in which a shadow is formed with a book original B. The image has a central black stripe S2 and edge black frames S1 and S3. When an original has a certain thickness, the change in intensity of the shadow over time has a slope as shown in FIG. 13. In FIG. 13, the axis of ordinate represents intensity and the axis of abscissa represents intensity. Region ΔAt1 corresponds to reflection from an original cover having a standard reflectance, region Δt2 represents reflection from an original edge, i.e., a shadow, and t3 represents a time corresponding to an image start point. The longer the region t2 (portion of the shadow), the thicker the original Even with a flat sheet, if there is a folded portion which floats from the remaining portion of the sheet or with a thick sheet, a shadow is similarly formed. When the slope of the intensity curve of an image is detected with a line sensor, the edge of the original can be recognized. When the central black stripe of a book original is recognized, the obtained result can be utilized for centering for image formation. That is, when blank exposure for erasing the black stripe is performed as shown in FIG. 14, marks CE representing the center can be printed on a copy sheet Co. An arrow for printing blank exposure or center can be printed with a lamp using an LED array. Position information of a portion to be subjected to blank exposure is obtained by scanning the original and is stored in a memory. Therefore, the drum portions corresponding to the frames, the center, and the leading and trailing edge (where no image is formed) of an original can be erased (discharged) so that no toner is applied thereto.

Figure 15:
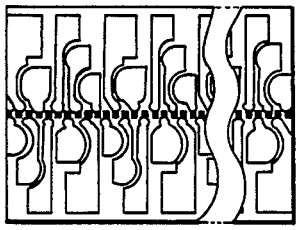
FIG. 15 is view showing the outer appearance of an LED array.

FIG. 15 shows the outer appearance of LED array elements. In this example, the element density is 16/mm. However, in order to perform blank exposure, deemphasis of the black frame of an original or center printing, elements are preferably arranged at a density of 2/mm to 3/mm using slightly thinner LED lamps used in conventional copying machines.

The system configuration of the apparatus of this embodiment will be described. FIG. 1 shows the schematic construction of the copying machine to which the present invention is applied. Two paper feed cassettes 2 and 3 are arranged at a side of a copying machine main body 1. A paper exhaust tray 4 is arranged at the other side of the copying machine main body 1. A corona charger 6, a blank exposure lamp 7, an optical system path 8, a developing roller 9, a transfer/separation corona charger 10, a cleaning roller 11, and a discharge lamp 12 are arranged around a photosensitive drum (OPC) 5. A glass contact 13 is arranged on top of the main body 1. An original on the glass contact 13 is illuminated with light from exposure lamps (two fluorescent lamps) 14. The light reflected from the original is reflected by mirrors 22 and 21 and is guided through a lens system 15 to the optical system path 8. The mirror 21 is a half mirror which serves to guide the original image to a line sensor 25 through a SELFOC lens 33. The line sensor 25 comprises two sensors each having 512 bits. Mirrors 23 and 24 are movable in the x- and y-axis directions by pulse motors 30 and 31. These mirrors 23 and 24 serve to detect the set condition of an original and to optically correct a ramp in the original. A paper sheet from the pater feed cassette 2 or 3 is guided to a pair of register rollers 18 by pickup rollers 16 or 17, respectively. A toner image on the photosensitive drum 5 is transferred onto the paper sheet by the transfer/separation corona charger 10 and is guided to a fixing roller 20 by a conveyor belt 19. A vacuum fan 26 is arranged below the conveyor belt 19 so as not to allow the paper sheet being removed from the conveyor belt 19. A heater is incorporated in the fixing roller 20 so as to heat the transferred image on the paper sheet and to fix it. The paper sheet with the fixed image thereof is stored in the paper exhaust tray 4. The apparatus further has a main drive AC motor 27, an optical system drive pulse motor 28, and a magnification changing pulse motor 29.

The copy process of the apparatus will be described below. When the power source switch is turned on, initialization is performed such as initialization of the photosensitive body, checking of the copying machine, exhaust of the remaining sheet in the copying machine, or initialization of the mechanism. When the heater temperature of the fixing roller 20 reaches a predetermined value, the copy operation can be started. A reload lamp at a display section is turned on to signal to the operator that the copy operation can now be performed. When a voice alarm switch is enabled, a voice "Copying is ready." is produced. When the copy button is depressed, a paper sheet is depressed and reaches the register rollers 18. A paper sensor detects that the paper sheet has reached the register rollers 18. In order to recognize the shape, set condition and the intensity pattern of an original as described above, the optical system scans the original while the copy process is interrupted. During this prescan, the light amount of the exposure lamp need only allow detection of original pattern and can therefore be 20 to 30% that required for actual scan. The prescan for pattern recognition is performed prior to paper sheet feed. If the operator does not designate a paper sheet of a particular size, selection of a proper size paper sheet is performed automatically. That is, after pattern recognition is performed, a paper sheet is supplied from a cassette storing paper sheets suitable for the selected magnification. When a paper sheet of suitable size is not available, the lens can be automatically moved to match the magnification with the paper size available. A size sensor is incorporated in each cassette, and a size signal from the sensor is supplied to a controller (FIG. 16). Recognition of an original pattern allows detection of a sheet or a book. Position and intensity information of the original is supplied, and the exposure lamp light amount and the developing bias are set. If the set condition of the original is abnormal, correction signals are supplied to mirror control motors or the pulse motors 30 and 31 so as to correct the optical path and to form an image at a normal position. After these preparatory procedures are completed, an image is formed by the optical system scan to be described below. The pulse motor 28 performs the optical system scan by short scan (variable) or full size scan in accordance with the selected original size. A latent image formed on the photosensitive drum 5 is visualized by a developing roller 9, is transferred and is fixed to complete the copy process. As has been described above, the blank exposure lamp 7 serves to deemphasize the black frame of a thick original or to eliminate the central black stripe of a book original in accordance with the position information.

FIG. 16 shows the configuration mainly including a controller 100 in the apparatus shown in FIG. 1. Input/output signals to and from units to be controlled and sensors are arranged around the controller 100. As described above, recognition of an original pattern is performed so as to perform an intensity, shape and set condition of an original. Thus, poor handling of an original as in a conventional apparatus is prevented.

The controller 100 comprises a known configuration having a microcomputer unit (to be referred to as an MCU hereinafter), a memory and the like.

A heater 101 is controlled by power control (phase control) by A/D converting a voltage level obtained from a thermistor 102 and controlling power in inverse proportion to the detected temperature. This control is performed without using a special circuit but by start of an internal counter and a zero-crossing detection function of the MCU. When the MCU detects a negative or positive going zero-crossing point of an AC power source voltage, the internal counter counting internal pulses is started to control power. Full-wave duty control is performed in accordance with this method so as to perform power control in accordance with the voltage level from the thermistor 102. In other words, when the detected temperature is low (voltage level from the thermistor is large), full-wave power is supplied. However, when the detected temperature is high (the voltage from the thermistor is small), the duty control of power is performed. The lamp control is performed by pulse width modulation (PWM) control by high-frequency drive. In view of the characteristics of fluorescent lamps 103, in order to decrease the rise time (time required to stabilize at a predetermined light amount) during cold time, the light amount is detected with a photosensor (solar cell). During the rise time, the full-cycle wave (full wave) is supplied to the fluorescent lamps 103 as in the case of the heater 101. When the light amount is stabilized, the amount is controlled to a predetermined value. In order to stabilize the operation and to shorten the rise time, the electrodes can be normally pre-heated. A blank exposure lamp 105 comprises an LED lamp and illuminates image portions which ordinarily result in a black frame, a central black stripe and the like or portions outside an original so that an extra amount of toner will not become attached to the drum. A main motor MM comprises an AC induction motor and is biased by a solid state relay SSR. The optical system is scanned with a pulse motor PM0. When the optical system is to be returned to the home position, a pulse speed twice that during the forward movement of the optical system is supplied to the motor for high speed return movement. In order to allow reproduction of an image of an excellent quality, the pulse motor PM0 is a 5-shape stepping motor which allows fine control. Blurring of an image by vibration of the motor can be reduced to the minimum by decreasing the vibration during scanning. A pulse motor PM1 is for moving the lens system when a magnification is changed. Pulse motors PM2 and PM3 perform correction of the optical path within a certain range to allow a normal copy operation when an original is set with a ramp. When the ramp of the original exceeds a certain range, only correction of the optical path does not allow acceptable image reproduction. Therefore, a warning is produced. A paper feed clutch MC1 and a register clutch MC2 are also connected to the controller 100. When the power source switch is turned on, a cooling fan motor FM is turned on by an AC motor when the power source is turned on. A vacuum motor VM comprises a DC motor and draws by suction a paper sheet from the lower side of the conveyor belt to feed the paper sheet normally. An electrification corona charger CC, a transfer corona charger TC and a discharge corona charger QC are arranged around a photosensitive drum 106 and are powered from an inverter power source in a high-voltage unit. A door switch DS and a heater overheating preventive switch HS are connected in series to constitute a safety circuit. When the switches DS and HS are disconnected from each other, a power relay PR is turned off and a power source down occurs. An interrupt signal is supplied to the controller 100 so as to detect an abnormality. A jam sensor 107 is arranged in a paper feed cassette to perform a paper sheet size. A jam sensor 108 is arranged in a transfer/separation section, and a jam sensor 109 is arranged in a paper exhaust section. An operation display section 110 has an automatic switch A, a manual switch M, a copy start key COPY, a clear/stop key C/S, a counter UP key⊕, a counter DOWN key⊖, and a multi key M for continuing the copy operation until the key C/S is depressed irrespective of the count of the counter. Counter display and function display are performed with LEDs. The apparatus with a speech synthesizer and the controller is backed up with a 3 V cell battery 111 when a power failure occurs. An original sensor 112 detects an original when the operator forgets to remove it after a copy process. More specifically, if an original is still on the original table a predetermined time after a copy process, the sensor 112 produces a warning. The controller 100 also has a residual toner detector 113 and a recovered toner overflow detector 114 connected thereto. These detectors comprise photosensors.

The apparatus of this embodiment has a speech synthesizer to provide diagnosis and failure guidances. A speech synthesizer 115 comprises a C-MOSIC and is backed up with the 3 V cell battery 111. Therefore, even if a power failure occurs, the speech synthesizer can continue to operate. The apparatus also has a human body sensor (infrared ray sensor) 119. When somebody draws close to the machine, the apparatus provides a guidance to improve operability. A discharge lamp 116 is used for blank exposure. A switch MS1 detects the optical system at the home position, and a limit switch MS2 is for detecting an overrun of the optical system. When the optical system is at the home position, the switch MS1 is closed. When the optical system is about to fall outside the scan range, the switch MS2 is closed to return the optical system. An AC zero-crossing pulse generator 17 detects a zero-crossing pulse of AC power and supplies a detection output to the controller to start the internal counter and to perform PWM (phase control). In synchronism with the main motor MM, a pulse generator 118 rotates an encoder. Pulses generated from the encoder are counted to perform sequence control.

Figure 17:
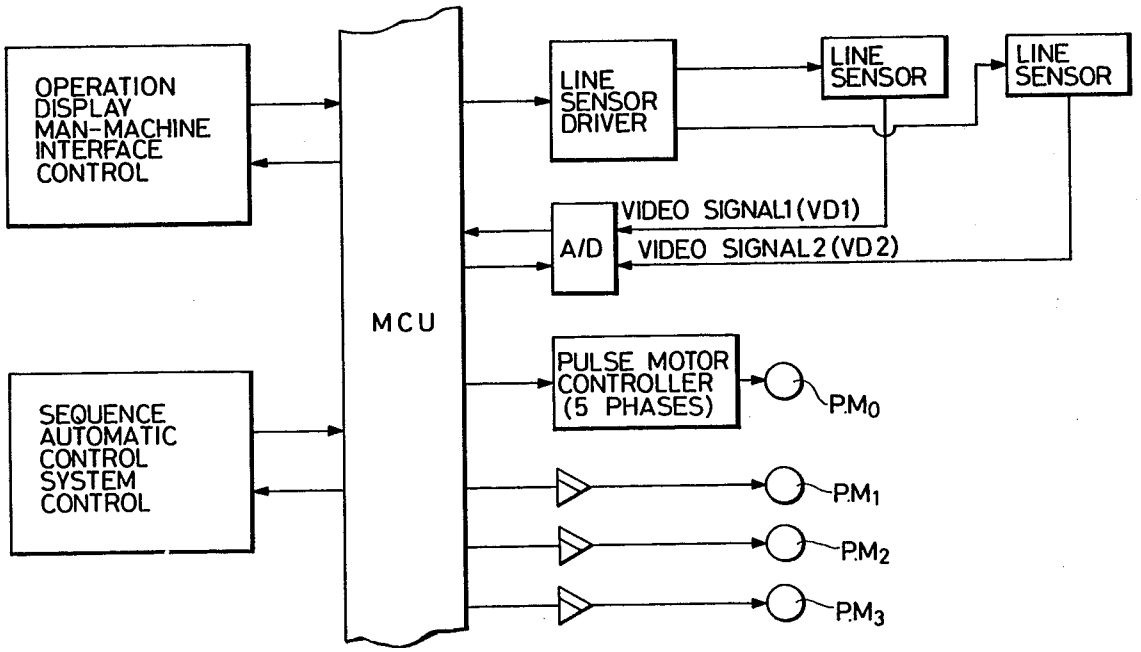
FIG. 17 is a block diagram of a circuit for recognizing an original pattern.

FIG. 17 is a block diagram showing the circuit configuration for performing recognition of an original pattern. In accordance with an instruction from the MCU, the line sensor is scanned by a line sensor driver. Video signal outputs VD1 and VD2 from the line sensor are A/D converted to perform arithmetic operations. In accordance with the results obtained with the arithmetic operations, the pulse motors are controlled for performing feed-back to the operation display man-machine interface control and to the sequence automatic control system control (exposure lamp, the high-voltage power source, the bias power source, and so on), and performing correction of the optical system path.

Another embodiment will be described. In the above embodiment, prescan is performed to perform recognition of an original pattern. Prescan allows recognition of an overall original and setting of the process conditions to allow production of a copy of an excellent quality. However, this method allows two exposure operations for producing a single copy, which is inconvenient economically for the user.

A real time control method will now be described.

A black frame can be eliminated by simultaneously performing the original surface exposure and the blank exposure or by performing the blank exposure after the original surface exposure. In the arrangement shown in FIG. 1, the blank exposure lamp 7 is arranged behind the optical system path 8. That is, the blank exposure lamp 7 is interposed between the developing roller 9 and the optical system path 8. Then, real time recognition can be performed during recognition of the original edge. Feedback for controlling the electrification condition, development bias, and light amount of the exposure lamp is performed with slight delays. However, the control procedures must involve certain hysteresis so as not to cause overshoot due to too high a sensitivity in accordance with detection results.

Figure 18:
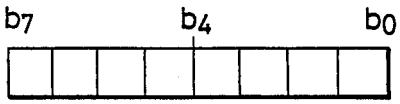
FIG. 18 is a diagram showing an original corner detection register.

As has been described above, the set condition of the original can be discriminated by reading the corners P1 and P2. In order to perform real time discrimination of the shape of an original, the corners P3 and P4 are further discriminated to allow a recognition of a rectangular shape. In order to allow detection of the shape of an original, the number of corners (or edges) of the original is counted to discriminate if the original is a rectangular or square original or a polygonal original. FIG. 18 is a register which detects and stores the number of corners of the original. Flags are set from MSB b7. When all the flags are set for bits b7 to b4, the original can be determined as a normal rectangular original. However, if there are 5 or more corners, the original is determined to be an original of an indefinite shape or an abnormal original. Using an LCD dot matrix, the positions of the detected corners are displayed at dots on the LCD. Then, the displayed dots representing the corners can be connected to display an original pattern. When a display is performed, whether or not an original of an indeterminate shape or normal shape is set within a predetermined range or whether or not an original is set in a good condition can be displayed to the operator.

Since original pattern recognition is performed in real time, an original pattern is displayed as the original is scanned. Therefore, when scanning of the original is completed, the overall original pattern is displayed. When the original falls outside the image forming range corresponding to that of the photosensitive drum, the subsequent copy process is interrupted and the apparatus asks the operator if he would like to continue the copy process. If the operator depresses the OK key, the apparatus continues the process. However, if the operator depresses the NO key, an electrostatic latent image on the photosensitive drum is canceled. The drum is cleaned, and the apparatus instructs the operator to correct the set condition of the original. When it is determined that a problem will occur during the real time original pattern display, the operator can depress the NO key to interrupt the current copy process and to perform another image formation process for this original.

Figure 19:
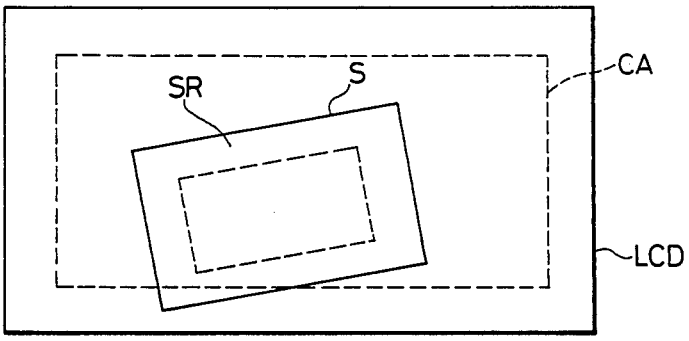
FIG. 19 is a representation showing a display of a sheet original.
Figure 20:
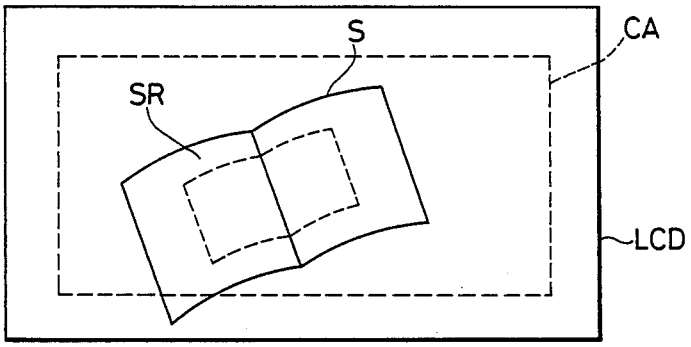
FIG. 20 is a representation showing a display of a book original.

FIGS. 19 and 20 show an original pattern displayed on a dot matrix display LCD. FIG. 19 corresponds to a case of a sheet original, and FIG. 20 corresponds to a case of a book, that is, a relatively thick original. The display LCD has a copy effective range CA displayed with dots. The original pattern corresponds to the manner in which the actual original S is placed on the original table. When a magnification is specified, an image pattern SR of a selected magnification can also be displayed. Display of the pattern SR can be performed by multiplying the display of the original S with the selected magnification and displaying in accordance with the obtained result.

The operator can determine if the original is set in a suitable condition referring to the display on the LCD.

If the original pattern need not be detected, the manual mode can be selected to perform a copy process as in a conventional copying machine.

Figures 1, 21:
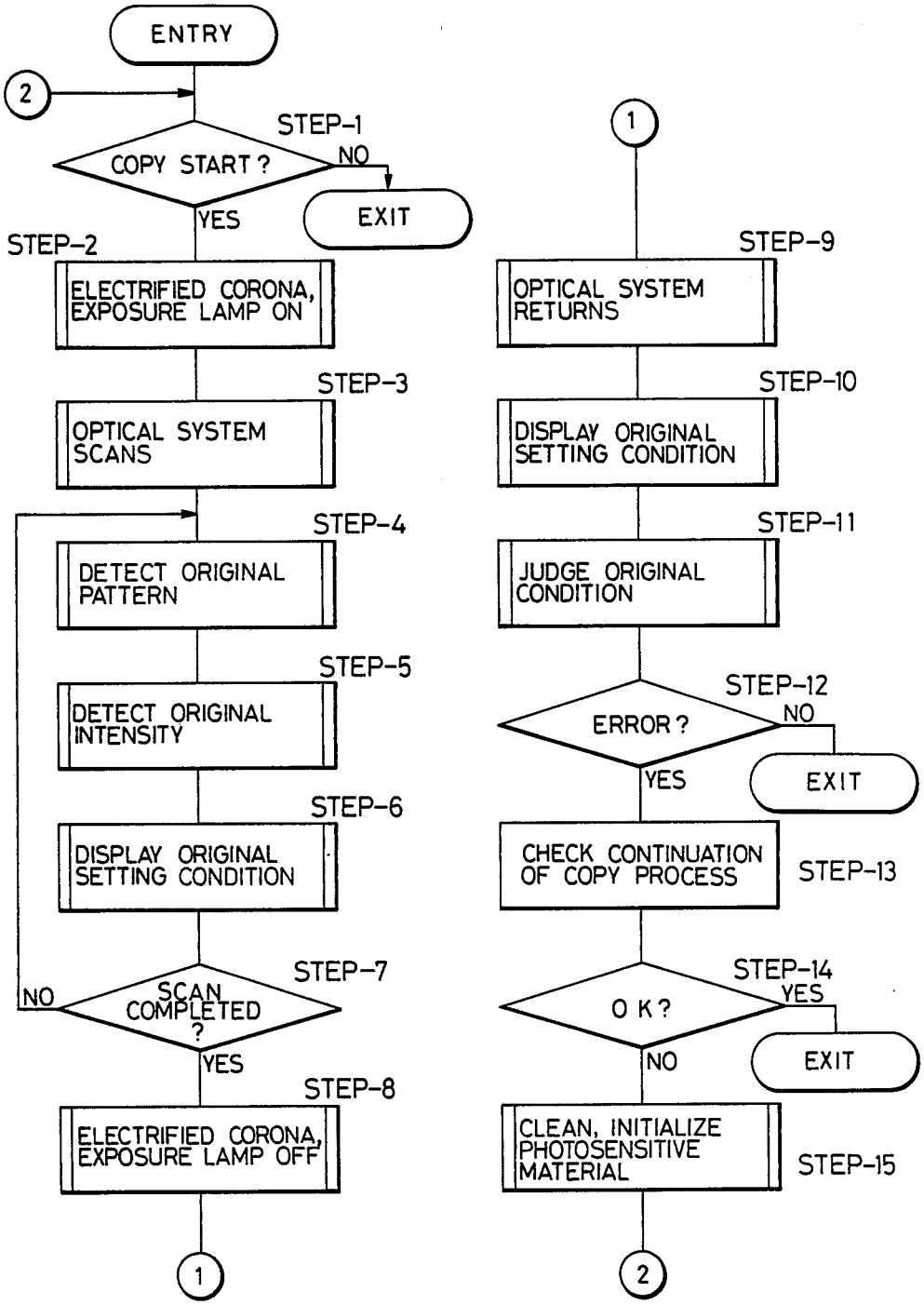
Figures 2, 21:
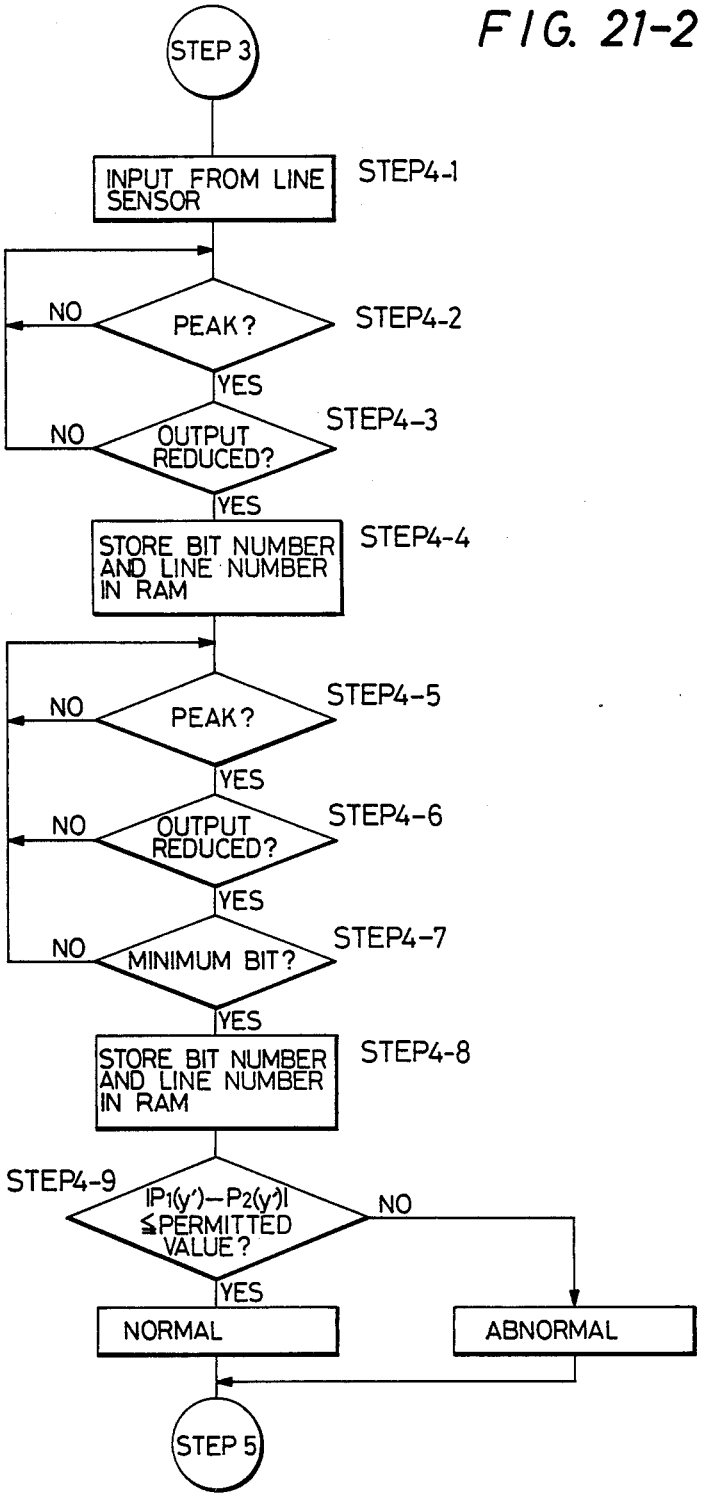
Figure 22:
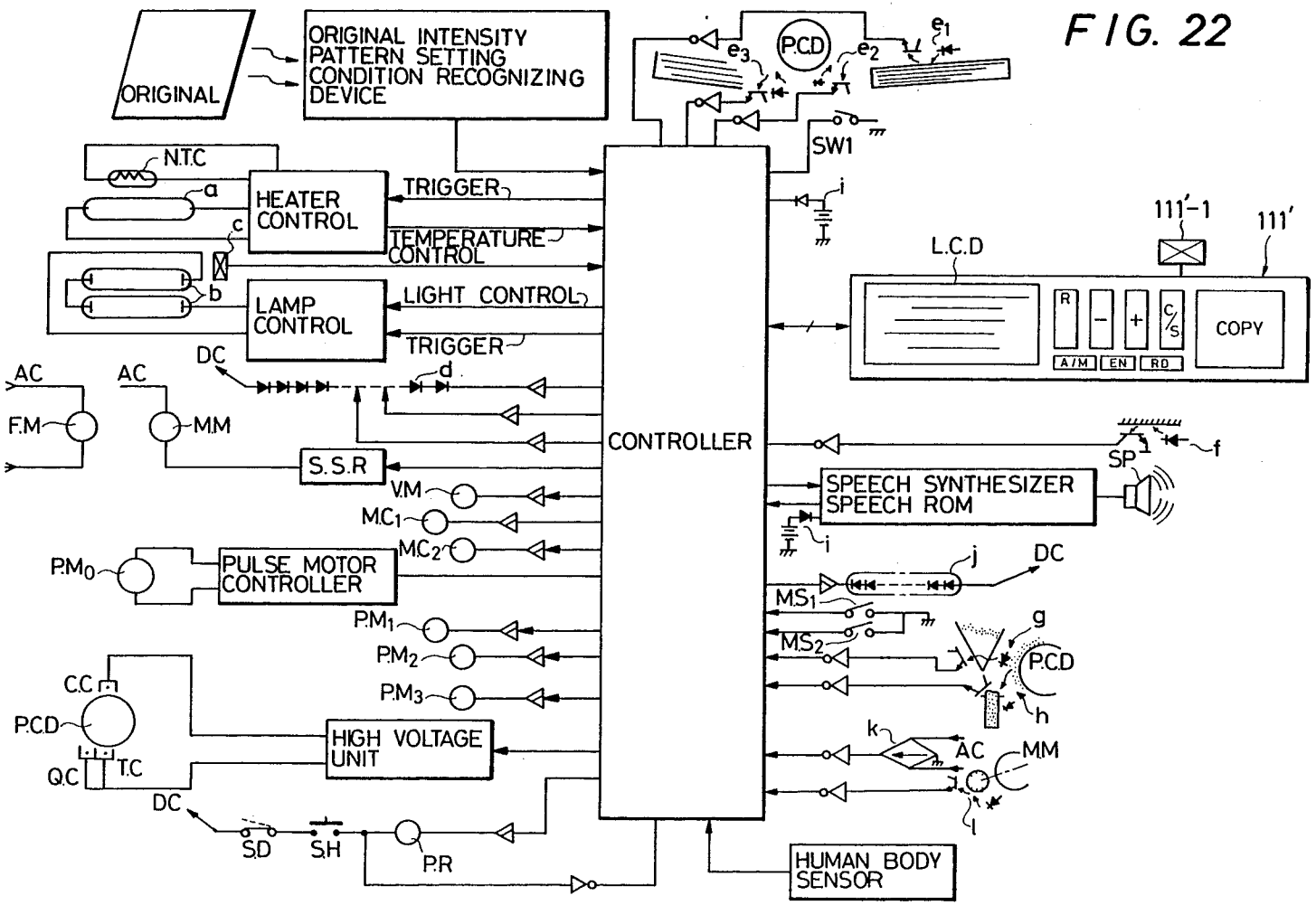
FIG. 22 is a block diagram showing the system configuration of an image formation apparatus according to another embodiment of the present invention.

FIG. 21–1 is a flow chart showing a series of copy processes in accordance with the pattern detection method. FIG. 22–2 is a flow chart showing the detection method of the original pattern shown in FIG. 21–1. The flow charts will be described below in sequential order.

STEP-1: It is checked if the copy start key is depressed.

STEP-2: The electrification corona charger is turned on to form an electrostatic latent image on the photosensitive drum, and the exposure lamp is turned on.

STEP-3: The optical system scans the original to form an image.

STEP-4: Real time detection of an original pattern is performed.

STEP-5: Recognition of the intensity pattern of the original is performed as in the case of STEP-4. Since this recognition is performed in real time, the light intensity of the exposure lamp is controlled such that the current recognized value is used as an optimal expected value for the next recognized intensity. For this reason, although there is a slight delay in feedback, no practical problem is experienced. However, in order not to allow oscillation of the lamp intensity, some threshold levels are used.

STEP-6: Corners of the original are detected, and the detected corners are connected to draw a shape of the original on the display. Every time the shape of the original is detected, it is displayed to allow the operator easy recognition of the original condition.

STEP-7: Scan completion is determined in accordance with the presence/absence of the original. When there is no more original portion of a small original, the optical system performs a short return.

STEP-8: The electrification system and exposure lamp are turned off.

STEP-9: The optical system is reversed and is returned to the home position.

STEP-10: The condition of the original is displayed. The thickness of the original (i.e., whether it is a sheet of a book) is discriminated and displayed.

STEP-11, 12: It is judged whether the set condition of the original is normal. If the set condition of the original is determined to be normal, the contents of the original are recognized in the subsequent processing. The development bias and the transfer corona conditions are set to provide an optimal original intensity. The blank exposure is performed correctly in accordance with the position information recognized in STEP-4.

STEP-13: In case it is determined in STEP-12 that the set condition of the original is abnormal, whether the copy process to be continued is asked to the operator. An audio guidance or a video display is produced.

STEP-14: The response of the operator is inputted through the key switch. If the response of the operator is YES (the key switch R is depressed), the flow advances to the next process.

STEP-15 The image formed thus far is cleaned to initialize the photosensitive body to prepare for the next copy process. During this time, the operator corrects the set condition of the original to the normal condition to prepare for the next copy process.

STEP-4-1: The intensity data of the original as shown in FIG. 13 is read from the line sensor.

STEP-4-2: It is judged if the read intensity information is above a predetermined level, i.e., the standard reflected intensity from the original cover. If YES, the flow advances to the next step. If NO, the flow returns to STEP-4-1.

STEP-4-3: The read intensity information is differentiated to examine if the output is reduced or attenuated. If the differentiated value is a negative certain value, the intensity curve is inclined in the negative direction at a certain slope. Therefore, the corresponding image portion can be determined to be an original edge. If this portion is a start portion of the original, it can be determined to be a corner of the original.

STEP-4-4: The x'-coordinate (bit number) in the main scan direction x' and the y' coordinate (line number) in the subscan direction y' are stored in the RAM, and the corresponding point is given as point P2.

STEP-4-5: Scan is continued. It is judged if a peak is detected as in STEP-4-2. If YES, the flow advances to the next step. If NO, the scan is continued.

STEP-4-6: It is judged if the output is reduced as in STEP-4-3. If YES, the flow advances to the next step. If NO, the flow returns to STEP-4-5.

STEP-4-7: If an original edge is detected, it is checked if the bit number in the main scan direction is a minimum bit from which the intensity change changes from decreasing to increasing curve. If YES, the flow advances to the next step. If NO, the flow returns to STEP-4-5 to continue scanning.

STEP-4-8: The bit number (minimum bit) in the main scan direction and the line number in the sub scan direction are stored in the RAM. The corresponding point is given as point P1.

STEP-4-9 If the difference in the y'-coordinates (line number) of the points P2 and P1 in the y' direction is determined to be below a permitted value, it is determined that the original is set normally. However, if the difference is over the permitted value, it is determined that the original is set abnormally.

FIG. 22 is a block diagram showing the configuration of the apparatus having an LCD. The configuration shown in FIG. 22 is different from that shown in FIG. 16 only in the configuration of an operation display section 110. The circuit shown in FIG. 22 has an operation display section 110' which, in turn, has a copy start key COPY, a clear/stop key C/S, a counter UP key ⊕, a counter DOWN key ⊖, and a key R. In the automatic key, the set condition of the original is recognized. If the set condition of the original cannot be satisfactorily corrected with only the correction of the optical axis, a warning is produced to have the operator decide if the copy process is to be continued. If the user decides that he wants to continue the copy process, he depresses the key R. Then, the subsequent copy process is performed. If the operator decides that he wants to cancel the current process and restart the copy process from the beginning, he does not depress the key R. Then, after a predetermined period of time (3 to 5 seconds), cleaning of the photosensitive body and the initialization of the mechanism are performed automatically to prepare for the next copy process. When a key A/M is depressed once, the copying machine is set in the automatic mode. When the key A/M is depressed twice, the copying machine is depressed in the manual mode. The selected copy mode is displayed at the LCD display. The section 110 also has an enlargement key EN for setting the enlargement mode and a reduction key RD for setting the reduction mode. The keys EN and RD provide analog/nonstep magnification changes. The selected magnification is also displayed at the display. The LCD display comprises a dot matrix multifunctional display and is capable of displaying all the information concerning the copy process. When the original pattern is detected in the manner described above, the edge and corners of the original can be determined. A corresponding output can be used to control the dots of the LCD to display the detected original pattern. A buzzer 111-1' produces a sound when an erroneous operation occurs. The circuit also has a human body sensor (infrared ray sensor). The human body sensor detects a human body when someone comes close to the copying machine. Then, the copying machine provides a guidance to the operator to improve the operability.

When a diagnosis key SWi is depressed, the position and state of a failure, if any, are displayed at the display.

The present invention is not limited to the particular embodiments described above, and many other changes and modifications may be made within the spirit and scope of the present invention.

What is claimed is:

1. An image formation apparatus comprising:
scanning means for exposure-scanning an original;
imaging means for focusing an image of the original exposure-scanned by said scanning means onto a receiving member;
recognizing means for recognizing a set condition of the original; and
control means for controlling said imaging means in accordance with an output from said recognizing means wherein said control means corrects an optical axis of said imaging means.

2. An image formation apparatus according to claim 1, wherein said imaging means includes a mirror for reflecting light from the original and said control means controls the inclination of the mirror.

3. An image formation apparatus according to claim 1, wherein said recognizing means detects the amount of the ramp of the original placed on the platen.

4. An image formation apparatus comprising:
scanning means for exposure-scanning an original;
imaging means for focusing an image of the original exposure-scanned by said scanning means onto a receiving member;
recognizing means for recognizing a set condition of the original; and
control means for controlling said imaging means in accordance with an output from said recognizing means wherein said recognizing means operates by means of said scanning means.

5. An image formation apparatus according to claim 4, wherein said imaging means includes a mirror for reflecting light from the original and said control means controls the inclination of the mirror.

6. An image formation apparatus according to claim 4, wherein said recognizing means detects the amount of the ramp of the original placed on the platen.

7. An image formation apparatus comprising:

image forming means for exposure-scanning an original to form an image on a recording medium;
erasing means for erasing the image formed by said image forming means;
recognizing means for recognizing a shades formed by the original; and
control means for controlling an operation of said erasing means in accordance with an output from said recognizing means.

8. An image formation apparatus according to claim 7, wherein said image forming means forms the image on a photosensitive medium and said erasing means includes an array of light emitting means for exposing the photosensitive medium,

9. An image formation apparatus according to claim 7, wherein said control means controls said erasing means such that images outside the area of the original are erased.

10. An apparatus according to claim 7, wherein said recognizing means operates by means of the exposure-scanning by said image forming means.

11. An apparatus according to claim 7, wherein said recognizing means detects an edge or corner of the original.

12. An image formation apparatus comprising:
scanning means for exposure-scanning an original;
recognizing means for recognizing a set condition of the original during scanning by said scanning means; and
display means for displaying a pattern of the original in accordance with an output from said recognizing means during scanning by said scanning means.

13. An apparatus according to claim 12, wherein said display means displays an edge of the original.

14. An image formation apparatus comprising:
scanning means for exposure-scanning an original;
recognizing means for recognizing a set condition of the original during scanning by said scanning means; and
display means for displaying a set condition of the original in accordance with an output from said recognizing means during scanning by said scanning means.

15. An apparatus according to claim 14, further comprising a platen for supporting the original thereon, wherein said display means displays the contour of the original placed on the platen in order to display the position of the original.

16. An image formation apparatus comprising:
means for exposure-scanning an original to form an image on a recording member;
means for recognizing intensity information of the original; and
means for adding specified information to a reproduced image of the original in accordance with output from said recognizing means.

17. An apparatus according to claim 10, wherein said adding means includes means for erasing the image formed by said image forming means, and for adding the specified information after erasing one portion of the formed image.

18. An image formation apparatus comprising:
scanning means for exposure-scanning an original;
means for changing magnification for reproduction of the original;
recognizing means for recognizing a set condition of the original during scanning by said scanning means; and
display means for displaying a pattern or reproduction position of the original corresponding to a reproduction magnification in accordance with an output from said recognizing means during scanning by said scanning means.

19. An apparatus according to claim 12, wherein said display means further displays the position in which the original is placed.

20. An image formation apparatus comprising:
a platen for supporting an original thereon;
scanning means for exposure-scanning the original placed on the platen;
imaging means for focusing an image of the original exposure-scanned by said scanning means onto a receiving member;
recognizing means for recognizing the position on the platen in which the original is placed; and
control means for controlling said imaging means in accordance with an output from said recognizing means;
said imaging means including a mirror for reflecting light from the original and said control means controlling the inclination of the mirror.

21. An image formation apparatus comprising:
a platen for supporting an original thereon;
scanning means for exposure-scanning the original placed on the platen;
imaging means for focusing an image of the original exposure-scanned by said scanning means onto a receiving member;
recognizing means for recognizing the position on the platen in which the original is placed; and
control means for controlling said imaging means in accordance with an output from said recognizing means;
said recognizing means detecting the amount of the ramp of the original placed on the platen.

22. An image formation apparatus comprising:
a platen for supporting an original thereon;
scanning means for exposure-scanning the original placed on the platen;
imaging means for focusing an image of the original exposure-scanned by said scanning means onto a receiving member;
recognizing means for recognizing the position on the platen in which the original is placed;
control means for controlling said imaging means in accordance with an output from said recognizing means; and
means for reading an image of the original exposure-scanned by said scanning means and for generating an electric signal, wherein said recognizing means recognizes said position in response to the electric signal from said reading means.

23. An image formation apparatus comprising:
a platen for supporting an original thereon;
scanning means for exposure-scanning the original placed on th platen;
imaging means for focusing an image of the original exposure-scanned by said scanned means onto a receiving member;
recognizing means for recognizing the position on the platen in which the original is placed;
control means for controlling said imaging means in accordance with an output from said recognizing means; and
means for generating an alarm indicating an invalid placing of the original when it is judged that the amount of a control operation by said control means to said imaging means exceeds a predetermined level.

24. An image formation apparatus comprising:
a platen for supporting an original thereon;
a recording medium;
scanning means for exposure-scanning the original placed on the platen;
projecting means for projecting an image of the original exposure-scanned by said scanning means onto the recording medium;
read means for reading the image of the original exposure-scanned by said scanning means and generating an electric signal;
first recognizing means for recognizing the position on the platen in which the original is placed in response to the electric signal generated by said means; and
second recognizing means for recognizing an image density of the original in response to the electric signal generated by said read means,
wherein the electric signal generated by said read means is utilized commonly for said first and second recognizing means.

25. An apparatus according to claim 24, further comprising means for controlling the amount of exposure by said scanning means in accordance with the image density recognized by said second recognizing means.

26. An image formation apparatus comprising:
a platen for supporting an original thereon;
reading means for reading an image of the original on the platen by scanning the original and generating an electric signal, said reading means including an image sensor movable in synchronization with a scan of the original;
image forming means for forming an image according to the original;
first recognizing means for recognizing the position on the platen in which the original is placed in accordance with the electric signal generated by said reading means; and
second recognizing means for recognizing an image density of the original in accordance with the electric signal generated by said reading means,
wherein the electric signal generated by said reading means is utilized commonly for said first and second recognizing means.

27. An image formation apparatus according to claim 26, wherein said first recognizing means recognizes said position in response to of image densities of the areas inside the original and outside the original.

28. An image formation apparatus according to claim 26, further comprising means for controlling said image forming means in response to outputs from said first and second recognizing means.

29. An image formation apparatus according to claim 26, further comprising a photo-sensitive member and projection means for projecting the image of the original onto the photo-sensitive member, wherein said image forming means performs the image formation in response to the image projected onto the photo-sensitive member.

30. An image reading apparatus comprising:
a platen for supporting an original thereon;
reading means for reading an image of the original on the platen by scanning the original and generating an electric signal, said reading means including an image sensor movable in synchronization with a scan of the original;
first recognizing means for recognizing the position on the platen in which the original is placed in accordance with the electric signal generated by said reading means; and
second recognizing means for recognizing an image density of the original in accordance with the electric signal generated by said reading means.
wherein the electric signal generated by said reading means is utilized commonly for said first and second recognizing means.

31. An image reading apparatus according to claim 30, wherein said first recognizing means recognizes said position in response to image densities of the areas inside the original and outside the original.

32. An image formation apparatus comprising:
image forming means for exposure-scanning an original to form an image on a recording medium;
erasing means for erasing the image formed by said image forming means;
recognizing mans for recognizing whether the original is book-shaped; and
control means for controlling said erasing means when the original is recognized as book-shaped by said recognizing means.

33. An image formation apparatus according to claim 32, wherein said control means controls said erasing means such that the image according to a center region of the original is erased.

34. An image formation apparatus according to claim 32, wherein said control means controls said erasing means such that the image according to edge regions of the original are erased.

35. An image formation apparatus according to claim 32, wherein said recognizing means includes means for detecting a density of the original and recognizes a book-shaped original in response to change in detected density.

36. An image forming apparatus comprising:
a platen for supporting an original;
scanning means for exposure-scanning the original on the platen;
image forming means for forming an image of the original exposure-scanned by said scanned means onto a recording medium, said image forming means having reading means for reading the entire image of the original in a direction normal to the scan direction of the original and for generating an electric signal; and
recognizing means for recognizing the shape of the original in response to the electric signal generated by said image forming means simultaneously with the scanning operation of the original during the image formation.

37. An image forming apparatus according to claim 36, wherein said recognizing means recognizes a density of the image of the original.

38. An image forming apparatus according to claim 37, wherein said recognizing means recognizes the position on the platen in which the original is placed.

39. An image forming apparatus according to claim 36, wherein said recognizing means recognizes the position on the platen in which the original is placed.

40. An image forming apparatus according to claim 39, wherein said recognizing means recognizes a skew angle of the original.

41. An image forming apparatus according to claim 39, further comprising means for interrupting an image forming operation by said image forming means in response to said position recognizing means.

42. An image formation apparatus according to claim 41, wherein said control means interrupts the operation of said image forming means when it is decided, in accordance with the output from said recognizing means, that a part of the original is in an area other than the area where image formation is possible.

43. An image apparatus comprising:

a platen for supporting an original;

scanning means for exposure-scanning the original on the platen;

projection means for projecting an image of the original exposure-scanned by said scanning means onto a recording medium;

image forming means for visualizing the image projected by said projection means;

reading means for reading the entire image of the original in a direction normal to the scanning direction of the original and generating an electric signal; and recognizing means for recognizing the position on the platen in which the original is placed in response to the electric signal generated by said reading means.

44. An image forming apparatus according to claim 43, further comprising means for detecting a density of the original in response to the electric signal generated by said reading means.

45. An image forming apparatus according to claim 43, wherein said reading means includes a line sensor.

46. An image forming apparatus according to claim 45, wherein said line sensor reads the original in one-to-one magnification.

47. An image forming apparatus according to claim 43, further comprising means for detecting the size of the original in response to the electric signal generated by said reading means.

48. An image forming apparatus according to claim 47, further comprising means for controlling a scanning distance of said scanning means in response to said size of the original detected by said size detection means.

49. An image forming apparatus comprising;

a platen for supporting an original;

scanning means for exposure-scanning the original on the platen;

image forming means for forming an image of the original exposure-scanned by said scanning means onto a recording member, said image forming means having reading means for reading an image of the original and generating an electric signal; and display means for displaying at least one of a shape and a location condition of the original in response to the electric signal generated by said reading means.

50. An image forming apparatus according to claim 49, wherein said display means graphically displays at least one of the shape and the location condition of the original.

51. An image forming apparatus according to claim 49, wherein said reading means includes a line sensor.

* * * * *

UNITED STATES PATENT AND TRADEMARK OFFICE

CERTIFICATE OF CORRECTION

PATENT NO. : 4,811,047

DATED : March 7, 1989

INVENTOR(S) : MASAO HOSAKA, ET AL.

It is certified that error appears in the above-identified patent and that said Letters Patent is hereby corrected as shown below:

COLUMN 2

Line 16, "origianl" should read --original--.

COLUMN 3

Line 46, "21" should read --21.--.
Line 51, "laps," should read --lamps,--.
Line 62, "th" should read --the--.

COLUMN 4

Line 19, "case," should read --cases,--.
Line 37, "nit" should read --unit--.

COLUMN 5

Line 51, "sensor" should read --sensor.--.
Line 65, "position" should read --position.--.

COLUMN 6

Line 37, "time," should read --time.--.

COLUMN 7

Line 4, "$\Delta$At1" should read -- $\Delta$t1--.
Line 10, "nal" should read --nal.--.

UNITED STATES PATENT AND TRADEMARK OFFICE

CERTIFICATE OF CORRECTION

PATENT NO. : 4,811,047

DATED : March 7, 1989

INVENTOR(S) : MASAO HOSAKA, ET AL.

It is certified that error appears in the above-identified patent and that said Letters Patent is hereby corrected as shown below:

COLUMN 15

Line 5, "shades" should read --shadow--.
Line 14, "medium," should read --medium.--.
Line 57, "claim 10," should read --claim 16,--.

COLUMN 16

Line 6, "claim 12," should read --claim 18,--.
Line 58, "th" should read --the--.
Line 60, "scanned" should read --scanning--.

COLUMN 17

Line 18, "means;" should read --read means;--.

UNITED STATES PATENT AND TRADEMARK OFFICE

CERTIFICATE OF CORRECTION

PATENT NO. : 4,811,047

DATED : March 7, 1989

INVENTOR(S) : MASAO HOSAKA, ET AL.

It is certified that error appears in the above-identified patent and that said Letters Patent is hereby corrected as shown below:

COLUMN 18

Line 9, "means." should read --means,--.
Line 22, "recognizing mans" should read --recognizing means--.
Line 45, "scanned means" should read --scanning means--.

Signed and Sealed this

Second Day of January, 1990

*Attest:*

JEFFREY M. SAMUELS

*Attesting Officer*

*Acting Commissioner of Patents and Trademarks*